US007611442B1

(12) United States Patent
Myrland

(10) Patent No.: US 7,611,442 B1
(45) Date of Patent: Nov. 3, 2009

(54) HURDLE FOR SPORT AND TRAINING USE

(75) Inventor: James W. Myrland, Verona, WI (US)

(73) Assignee: Rainbow Group, LLC, Middleton, WI (US)

( * ) Notice: Subject to any disclaimer, the term of this patent is extended or adjusted under 35 U.S.C. 154(b) by 1081 days.

(21) Appl. No.: 10/716,343

(22) Filed: Nov. 17, 2003

(51) Int. Cl.
*A63B 6/02* (2006.01)

(52) U.S. Cl. ..... 482/15; 482/16

(58) Field of Classification Search ..... 40/610, 40/606.01; 248/351, 688; 482/15, 17, 129, 482/131, 35, 36, 38, 39, 41, 42
See application file for complete search history.

(56) References Cited

U.S. PATENT DOCUMENTS

| | | | | |
|---|---|---|---|---|
| 468,625 | A | 2/1892 | Medart | |
| 615,443 | A | 12/1898 | Foster | |
| 732,680 | A | 6/1903 | Traxler | |
| 1,044,128 | A | 11/1912 | Brook | |
| 1,104,505 | A * | 7/1914 | Holworthy | 482/24 |
| 1,607,650 | A | 11/1926 | Smith | |
| 1,737,108 | A | 11/1929 | Craig | |
| 1,910,080 | A | 5/1933 | Austin | |
| 2,583,786 | A | 1/1952 | Marzucco | |
| 2,706,631 | A * | 4/1955 | Holmes | 482/17 |
| 2,718,397 | A | 9/1955 | Verkuilen | |
| 2,960,335 | A | 11/1960 | Shuttleworth | |
| 3,024,022 | A | 3/1962 | Goyete | |
| 3,061,306 | A | 10/1962 | Magill | |
| 3,394,932 | A * | 7/1968 | Leflar | 482/17 |
| 3,628,790 | A | 12/1971 | Gordon | |
| 3,685,824 | A | 8/1972 | Quinn | |
| 4,221,395 | A | 9/1980 | Carte | |
| 4,232,862 | A | 11/1980 | Mason | |
| D265,433 | S | 7/1982 | Koenig | |
| D268,214 | S | 3/1983 | Koenig | |
| 4,596,388 | A | 6/1986 | Burden | |
| 4,749,187 | A * | 6/1988 | Dellinger et al. | 482/17 |
| 4,793,288 | A | 12/1988 | Hoadley | |
| 4,878,303 | A * | 11/1989 | Banniza et al. | 40/606.14 |
| 4,892,302 | A | 1/1990 | Daigle | |
| 5,033,737 | A | 7/1991 | Moye | |
| 5,152,727 | A | 10/1992 | Moore et al. | |
| 5,199,930 | A | 4/1993 | Weber | |
| 5,205,799 | A | 4/1993 | Carbonero | |
| 5,334,119 | A | 8/1994 | Eloranta | |

(Continued)

*Primary Examiner*—Jerome Donnelly
(74) *Attorney, Agent, or Firm*—Craig A. Fieschko, Esq.; DeWitt Ross & Stevens S.C.

(57) ABSTRACT

A hurdle which may be readily converted between an erect/in-use state and a collapsed/readily storable state includes a crossbar having adjustable height, and the ability to be converted between a supporting state where one or more support legs maintain the hurdle in an erect position, and a folded state wherein the support legs are folded within the plane of the hurdle so that it will not readily stand erect. Thus, the crossbar may be collapsed to a lowest-height position and the hurdle may be put in its folded state for easy transport and storage, or the support leg(s) may be unfolded to its supporting state and the crossbar may be raised to a desired height so that the hurdle is ready for use. A handle may also be provided for allowing easy collection and transport of multiple hurdles.

36 Claims, 2 Drawing Sheets

U.S. PATENT DOCUMENTS 5,334,121 A * 8/1994 McPhilomy ..... 482/17
D356,352 S 3/1995 Johnson
D360,004 S 7/1995 Johnson
5,501,647 A * 3/1996 Snyder ..... 482/38
5,842,954 A 12/1998 Slupskiy
5,842,960 A * 12/1998 Yu ..... 482/131
6,063,005 A 5/2000 Schwartz
D442,553 S 5/2001 Urban et al.
6,416,447 B1 * 7/2002 Harmon ..... 482/129
6,447,427 B1 9/2002 Myrland et al.
6,475,116 B2 * 11/2002 Chen Wu ..... 482/15

* cited by examiner 100
102
116
106
122
106B
126
124
128
106A
118
134
116
104B
122
126
128
124
104
104A
108
118
112
120
110
132
114
130

100
102
116
122
106B
126
124
128
106
106A
134
116
104B
104
118
122
126
128
124
108
104A
118
110
114
120
112
130
132

HURDLE FOR SPORT AND TRAINING USE

FIELD OF THE INVENTION

This document concerns an invention relating generally to hurdles for use in sports, athletic training, and exercise and physical rehabilitation activities, and more specifically to hurdles of this nature which can at least partially give way when struck by users, and/or which are reconfigurable for varied use (e.g., to different hurdle heights) and/or for compact storage.

BACKGROUND OF THE INVENTION

Hurdles are commonly used in track and field and other athletic events, as well as in physical fitness and athletic training/rehabilitation activities. A common hurdle takes the form of an upper horizontal crossbar having downwardly-extending struts at its ends, and having legs or bases mounted to the bottom of the struts so that the struts stand erect with the crossbar suspended above the ground. Users may then jump to try to clear the upper crossbar. A series of hurdles is often spaced along a raceway so that a user running along the raceway may attempt to clear the hurdles in the user's path while running.

However, such hurdles suffer from several disadvantages. Initially, while some hurdles are made to safely break away if their upper crossbars are struck by users when they attempt to clear the crossbars, those that do not have this break-away feature can cause injury. For example, hurdlers who catch or otherwise strike the crossbar may carry the hurdle along with them as they fall, and they may and land on top of the hurdle and experience enhanced injury.

Further, while hurdles are common pieces of exercise equipment, they are not used as often as they might otherwise be because they are generally bulky and difficult to transport and store. They occupy significant floor space in athletic storage facilities (and storage space in buses and athletic transport vehicles), and thus are generally disliked in comparison to more compact and transportable equipment. They are also time-consuming and inconvenient to set up and store; ordinarily, one who is setting up hurdles along a raceway can only carry one or two hurdles at a time owing to their bulk and weight. Because the hurdles are generally laid out over a substantial distance along the raceway, the installer faces the inconvenience of making multiple trips to obtain hurdles, walking them out to their set-up points and setting them up, and then walking back to the storage/distribution point to get more hurdles to be carried out to new set-up points. This can lead to long set-up times (and later break-down times) where many hurdles are used, which is a significant problem where the athletic field needs to be used for other purposes (e.g., where another sporting event is scheduled to occur after the hurdling event). There is a recognized need for means for rapid distribution and installation of hurdles; see, e.g., U.S. Pat. No. 4,221,395 to Carte.

SUMMARY OF THE INVENTION

The invention involves a hurdle which is intended to at least partially solve the aforementioned problems. To give the reader a basic understanding of some of the advantageous features of the invention, following is a brief summary of preferred versions of the hurdle. To assist understanding, reference is made to a particularly preferred version depicted in the accompanying drawings. As this is merely a summary of preferred versions of the hurdle, it should be understood that more details regarding the preferred versions may be found in the Detailed Description set forth elsewhere in this document. The claims set forth at the end of this document then define the various versions of the invention in which exclusive rights are secured.

A hurdle 100 (see generally FIG. 1) is provided with an at least substantially horizontal upper crossbar 102 having opposing bar ends, and spaced first and second struts 104 and 106 which descend from the crossbar 102 toward the ground, with these struts 104 and 106 preferably being at least substantially vertically oriented. At least one of the struts 104 and 106 then includes a lower support leg 110 extending outwardly from the strut at or near its bottom, with the support leg 110 having an outer leg end 114 opposite the strut from which it extends. The length of the support leg 110, or at least its outer leg end 114, may rest against the ground to maintain the struts 104 and 106 erect. Most preferably, only one of the struts 104 includes such a support leg 110, and only the outer leg end 114 of the support leg 110 contacts the ground so that the hurdle 100 is effectively supported at three points (at the bottom ends of the struts 104 and 106 and at the outer leg end 114 of the support leg 110) so that the hurdle 100 is stably supported in tripod-like fashion. One or more of the following features may then be incorporated for safety of use and/or ease of storage.

First, the support leg 110 may be made movable with respect to the crossbar 102 between a supporting state (FIG. 1) wherein the outer leg end 114 is situated out of a plane common to the first strut 104 and the crossbar 102 (with the support leg 110 thereby helping to support the hurdle 100 in an erect state), and a folded state (FIG. 2) wherein the outer leg end 114 is situated at least substantially within a plane common to the first strut 104 and the crossbar 102. This arrangement is preferably provided by making the support leg 110 rotatable about the axis of the first strut 104, as by providing a collar 120 at its end 112 opposite the outer leg end 114, and having this collar 120 rotatably fit about the first strut 104. The support leg 110 is preferably made resistant to rotation (or other motion) about the first strut 104 by providing an elastomeric member on the first strut 104 which bears against the support leg 110, so that the support leg 110 frictionally resists motion between the folded and supporting states. This elastomeric member can take the form of an elastomeric ring 132 fit about the first strut 104, and which bears against the collar affixed to the support leg 110. The collar 120 and elastomeric ring 132 can be closely fit between opposing stops 118 and 130 which radially protrude from the first strut 104, and which urge the elastomeric ring 132 against the collar. By allowing the support leg 110 to move between the folded and supporting states, the hurdle 100 can be made to more readily yield if a user strikes or falls upon the crossbar 102. Additionally, the hurdle 100 can be folded to a more convenient form for storage.

Second, the struts 104 and 106 may be made collapsible (compare FIGS. 2 and 3) so that they have variable length, i.e., so that the crossbar 102 of the hurdle 100 has variable height. This is preferably done by forming each strut of first and second strut members 104A and 104B, and 106A and 106B, which are adjacently situated in translatable relationship, whereby each strut 104 and 106 may be raised and lowered by translating its strut members 104A/104B and 106A/106B relative to each other. Such a translatable relationship may be provided by telescopically situating each second strut member 104B/106B within its first strut member 104A/106A, though other arrangements (e.g., forming the strut members 104A/104B and 106A/106B as adjacent slidable rails) are possible. A locking means is then preferably provided for locking the first and second strut members 104A/104B and 106A/106B together to provide desired strut lengths (and thus desired crossbar 102 heights); preferably, such locking means fix the strut members together at discretely spaced locations, e.g., at 10 cm increments, so that the crossbar 102 may be readily set to a variety of standard hurdle 100 heights (e.g., 50 cm, 60 cm, 70 cm, etc.). Additionally, such a locking means is preferably defeatable such that when a sufficient threshold force is applied to the crossbar 102 (e.g., when a user strikes or falls on the crossbar 102), the strut members 104A/104B and 106A/106B will translate relative to each other to at least partially collapse the struts 104 and 106. Conversely, the user may adjustably "snap" the struts 104 and 106, and thus the crossbar 102, to different desired heights with application of sufficient force. The locking means preferably takes the form of a locking member 124 which extends from the first strut member 104A/106A toward the second strut member 104B/106B, and which extends into discretely spaced indentations 122 defined along the length of the second strut member 104B/106B to engage it. The first strut member 104A/106A may include a locking aperture 126 through which the locking member 124 extends, with the locking member 124 then extending into one of the indentations 122 in the second strut member 104B/106B. The locking member 124 is preferably elastically biased from the first strut member 104A/106A into one of the indentations 122 of the second strut member 104B/106B such that the locking member 124 will disengage from the indentation 122 if sufficient force is applied to defeat the elastic biasing force. The elastic biasing may be implemented by an elastic band 128 (such as a helical spring formed as a closed loop) affixed to the locking member 124 and about the first strut member 104A/106A. Most preferably, the locking member 124 is provided as a tube through which the elastic band 128 extends, with the elastic band 128 extending about the first strut member 104A/106A and urging the tubular locking member 124 through a slot-like locking aperture 126 in the first strut member 104A/106A, and then into a semicylindrical slot-like indentation 122 in the second strut member 104B/106B. The curved surface of the tubular locking member 124 is then displaceable from the indentation 122 in the second strut member 104B/106B when a sufficient threshold force is applied that the elasticity of the elastic band 128 is defeated.

For ease of use and storage, the hurdle 100 may also include a collection handle 150 (FIG. 4) which allows one or more of the hurdles 100 to be easily collected and carried. A handle aperture 134 may extend through the crossbar 102 at a location between its ends, and a collection handle 150 having a shaft 152 sized to extend through the handle aperture 134 may then be provided. Where multiple hurdles 100 are used, they may be collected on the same collection handle 150 by extending the shaft 152 of the collection handle 150 through the aligned handle apertures 134 of adjacently-situated hurdles 100 (which are preferably fully collapsed prior to collection by placing their support legs 110 in the folded state, as in FIG. 2, and shortening their struts 104 and 106, as in FIG. 3). So that the hurdles 100 collected on the collection handle 150 do not readily fall off, the shaft 152 of the collection handle 150 preferably includes a first end 154 sized such that it cannot extend through the handle aperture 134 (e.g., by bending it out of coaxial alignment with the remainder of the shaft 152), and a second end 156 which is ordinarily sized to extend through the handle aperture 134, but which is reconfigurable to a size that cannot extend through the handle aperture 134. In the exemplary collection handle 150 of FIG. 4, this is done by extending a length of flexible tubing 158 from the first end 154 of the shaft 152 such that after the hurdles 100 are collected on the shaft 152 by inserting the second end 156 of the shaft 152 through their handle apertures 134, the tubing 158 can be extended from the first end 154 of the shaft 152 to fit about the second end 156, thereby forming the collection handle 150 into a closed loop.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
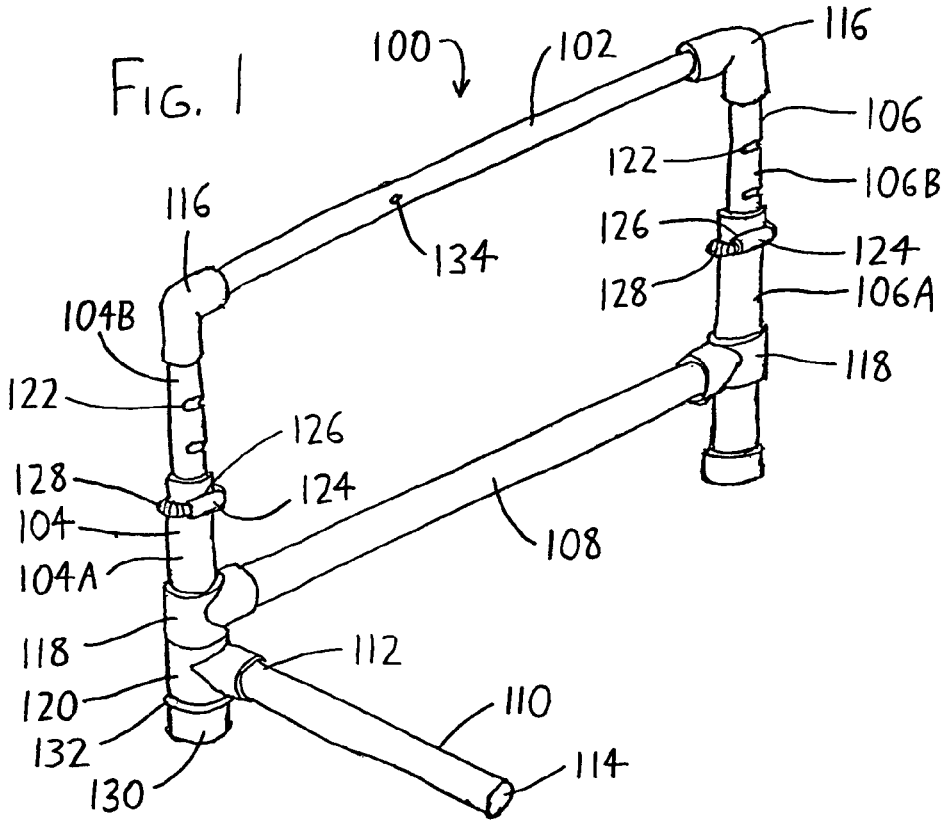
FIG. 1 is a perspective view of a hurdle 100 exemplifying the invention, shown erect with its support leg 110 situated in a supporting state.
Figure 2:
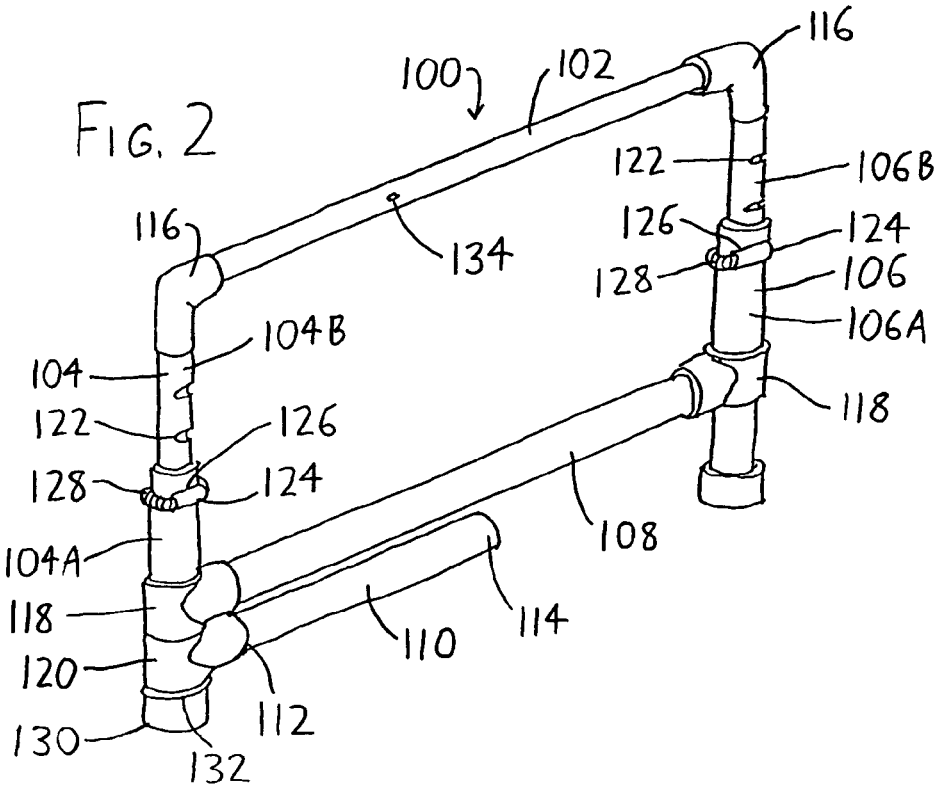
FIG. 2 depicts the hurdle 100 of FIG. 1 with its support leg 110 in the folded state.
Figure 3:
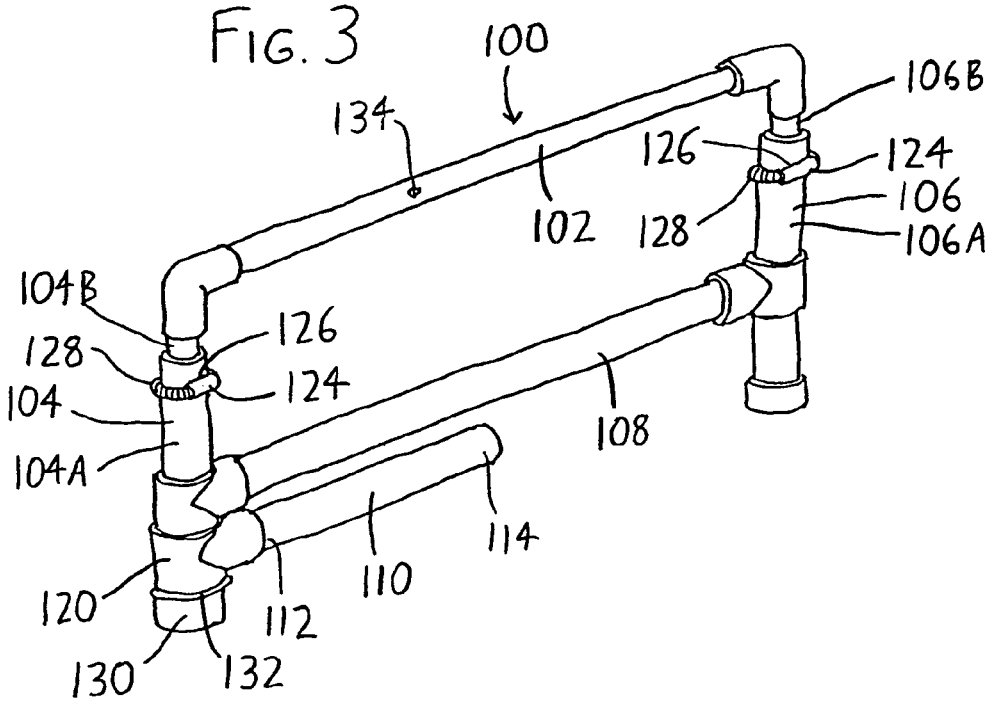
FIG. 3 depicts the hurdle 100 of FIG. 2 with its struts 104 and 106 collapsed, thereby decreasing the height of the crossbar 102.

Referring initially to FIG. 1, an exemplary preferred version of a hurdle is designated generally by the reference numeral 100. The hurdle 100 includes an upper crossbar 102, a first strut 104 descending from one of the ends of the crossbar 102 (with this first strut including a first strut member 104A which telescopically receives a second strut member 104B), an opposing parallel second strut 106 (which similarly includes a first strut member 106A and a second strut member 106B), a lower crossbeam 108 bridging the first and second struts 104 and 106, and a lower support leg 110 having an inner leg end 112 affixed to the first strut 104 and an outer leg end 114 at its opposing end. The crossbar 102, first and second struts 104 and 106, crossbeam 108, and support leg 110 are preferably all formed of lightweight materials, and may be readily constructed from plastic pipe (e.g., furniture-grade PVC tubing, which has fillers omitted during its manufacture to avoid the brittleness of common PVC tubing). This allows the connections between the various components to be readily made with common corner and T-connector pipe fittings, with the crossbar 102 being connected to the second strut members 104B and 106B by corner connectors 116, the crossbeam 108 and the first strut members 104A and 106A being connected by T-connectors 118, and the support leg 110 being connected to the first strut member 104A of the first strut 104 by a T-connector 120. The corners 116 are preferably firmly affixed to the crossbar 102 and the second strut members 104B and 106B by use of a strong friction-fit and/or by adhesives or other means of attachment, and the T-connectors 118 similarly firmly attach the crossbeam 108 to the first strut members 104A and 106A. However, the T-connector 120, while preferably being firmly affixed to the support leg 110, preferably has its through-hole portion (at the top of the T) rotatably fit about the first strut member 104A, thereby allowing the support leg 110 to rotate about the first strut member 104A (between, for example, the positions shown in FIGS. 1-2). Thus, the support leg 110 can be rotated into coplanar relationship with the crossbar 102, the first and second struts 104 and 106, and the crossbeam 108 (as illustrated in FIG. 2) so that the hurdle 100 will not readily stay erect, while alternatively the support leg 110 may be rotated out of the aforementioned plane (as shown in FIG. 1) so that its outer leg end 114 forms a three-point support base (along with the lower ends of the first and second struts 104 and 106) to maintain the hurdle 100 erect. Additionally, the size of the tubing chosen for the first strut members 104A and 106A and the second strut members 104B and 106B is preferably chosen such that the second strut members 104B and 106B closely fit within the first strut members 104A and 106A, but are capable of sliding to different locations therein, thereby allowing extension and retraction of the second strut members 104B and 106B within the first strut members 104A and 106A (and allowing the height of the crossbar 102 to be increased or decreased as desired, compare FIGS. 2-3).

So that the crossbar 102 of the hurdle 100 may be readily set to and maintained at different heights as desired, but at the same time may still be readily collapsed for ease of storage (and also so that the crossbar 102 readily yields if a user should, for example, strike or fall upon the crossbar 102), it is useful to provide some form of locking means for resiliently (but defeatably) maintaining the crossbar 102 at desired heights. While a simple frictional fit between the first strut members 104A and 106A and the second strut members 104B and 106B would provide an operational hurdle 100, such a frictional fit might degrade over time and/or in different temperature/moisture conditions, leading to inconvenience in setting the height of the hurdle 100 as desired. Thus, a particularly preferred arrangement is to provide locking means which defeatably lock the first and second strut members 104A/104B and 106A/106B at discretely spaced locations. In the exemplary hurdle 100, this is done by defining indentations 122 (e.g., semicylindrical notches) in the surfaces of the second strut members 104B and 106B at regular increments along their lengths (e.g., at every 10 centimeters), and then providing a locking member 124 on each of the first strut members 104A and 106A which extends toward the second strut members 104B and 106B to engage any adjacent indentation 122 therein. Each locking member 124 is elastically biased toward the second strut members 104B and 106B such that the locking member 124 will engage an indentation 122 when it is encountered, but at the same time the elastic biasing force may be defeated with the application of a sufficient threshold force, allowing readjustment of height. In the hurdle 100, each locking member 124—which may be formed by a short length of rigid tube—fits within a slot-like locking aperture 126 defined in the first strut members 104A and 106A (with this locking aperture 126 being situated adjacent the array of indentations 122 on the second strut members 104B and 106B). The locking member 124 is then elastically biased into the locking aperture 126, and thus onto the surface of the second strut members 104B and 106B (and into the indentations 122) by an elastic band 128 which fits through the locking member 124 and extends about the first strut members 104A and 106A. Such an elastic band 128 may take the form of a helical spring with its length looped into a ring-like shape, and with its ends held fixed within the interior of the locking member 124; alternatively, this elastic band 128 may take other forms, such as a length of elastomeric material (e.g., an O-ring like structure, or a length of elastic cord over which the locking member 124 is fit and having its ends tied together). The tension in the elastic band 128 will tend to urge the locking member 124 into the locking aperture 126 so that the locking member 124 will ride along the surface of the second strut members 104B and 106B, and will be urged into the indentations 122 when encountered. However, at the same time, when the crossbar 102 is urged toward or away from the crossbeam 108 with sufficient force, the locking member 124 will be urged out of any indentation 122 wherein it may be resting, allowing the second strut members 104B and 106B to slide within the first strut members 104A and 106A until another indentation 122 is encountered. Since a cylindrical tubular locking member 124 will situate a curved surface—a portion of its circumference—within the semicylindrical indentations 122, it will more readily disengage from an indentation 122 via a camming action than if it had surfaces shaped to cause greater interference with the indentations 122. In this manner, the crossbar 102 can be set to different heights, with the struts 104 and 106 "snapping" to different discrete heights during height variation.

As previously noted, the support leg 110 may be movable with respect to the crossbar 102 between the supporting state (FIG. 1) wherein the outer leg end 114 is situated out of a plane common to the remainder of the hurdle 100 (with the support leg 110 thereby helping to support the hurdle 100 in an erect state), and a folded state (FIG. 2) wherein the outer leg end 114 is situated at least substantially within the plane defined by the remainder of the hurdle 100. The T-connector 120 at the inner leg end 112 of the support leg 110 defines a collar rotatably fit about the first strut member 104A of the first strut 104. To assist in making the collar/T-connector 120 resistant to rotation about the first strut 104 except when such rotation is desired, it is useful to provide some means for frictionally resisting such rotation. A preferred arrangement is to closely situate the collar/T-connector 120 closely between the T-connector 118 and an endcap 130 provided at the bottom of the first strut 104 (on the first strut member 104A). The T-connector 118 and endcap 130 thereby serve as stops which radially protrude from the first strut member 104A to prevent significant translation of the collar/T-connector 120 about the first strut member 104A, and which may frictionally bear against the collar/T-connector 120 to hinder its rotation except when desired. More preferably, one or more elastomeric rings 132 are fit about the first strut member 104A, and are sandwiched between the collar/T-connector 120 and the endcap 130 (and/or the T-connector 118), so that the endcap 130 and/or T-connector 118 urge the elastomeric ring 132 against the collar/T-connector 120 so that the support leg 110 frictionally resists motion between the folded and supporting states.

Figure 4:
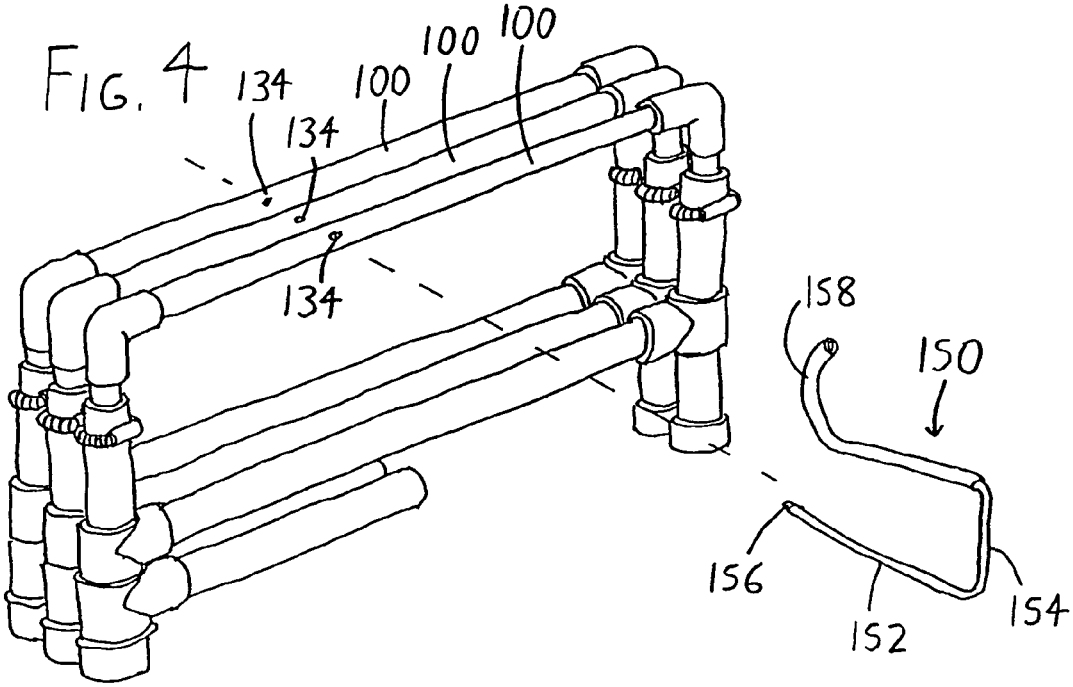
FIG. 4 is a view of several hurdles 100 in the collapsed state of FIG. 3, with the hurdles 100 being collected with their handle apertures 134 aligned so that a collection handle 150 may be inserted therein to allow easy collection, transport, and distribution of the multiple hurdles 100.

It is therefore seen that the hurdle 100 can be converted between its supporting state with the crossbar 102 raised to a desired height (e.g., as in FIG. 1), to a folded state wherein the crossbar 102 is lowered (as in FIG. 3) for easy transport and storage. To assist in transport and storage, it is also useful to include one or more collection handles 150 (as depicted in FIG. 4) to allow one or more hurdles 100 to be easily collected and carried. A handle aperture 134 is defined somewhere on the hurdle 100, preferably in the center of the crossbar 102 with the axis of the handle aperture 134 oriented generally perpendicular to the plane of the hurdle 100 when in its folded state. The collection handle 150 is then provided with a shaft 152 sized to extend through the handle aperture 134, such that the shaft 152 may be extended through the handle apertures 134 of multiple hurdles 100 whose handle apertures 134 are situated in aligned relationship (see FIG. 4). So that the hurdles 100 may be maintained on the collection handle 150 so that they do not readily slide off of it, the shaft 152 of the collection handle 150 is preferably provided with a first end 154 sized such that it cannot extend through the handle aperture 134. Such an arrangement is provided in the exemplary collection handle 150 of FIG. 4 by bending the first end 154 out of coaxial alignment with the remainder of the shaft 152. The shaft is then preferably provided with a second end 156 which is ordinarily sized to fit through the handle aperture 134, but which is reconfigurable to a size such that it cannot extend through the handle aperture 134. In the version of the hurdle 100 depicted in FIG. 4, this is simply achieved by affixing a length of flexible tubing 158 to the first end 154 of the collection handle 150, with such tubing being bendable to allow its open end to fit about the second end 156 of the collection handle 150 to form the collection handle 150 into a closed loop from which the collected hurdles 100 may not easily fall. Once the loop of the collection handle 150 is closed, a user may grasp the tubing 158 (or any other portion of the collection handle 150) and carry the collected hurdles 100 from one location to another.

Thus far, preferred versions of the invention have been discussed to illustrate different possible features of the invention and the varying ways in which these features may be combined. Other modifications are also considered to be within the scope of the invention. Following is an exemplary list of such modifications.

First, the various components of the hurdle 100 need not be made of tubing, and solid rods, solid or hollow rectangular beams, or other types of structural members may be used. Additionally, some components may be formed integrally (e.g., the crossbar 102 and the second strut members 104B/106B), or alternatively of assemblies of subcomponents.

Second, the ability of the first and second struts 104 and 106 to extend and retract may be realized by use of arrangements other than by forming them of telescoping first and second strut members 104A/106A and 104B/106B. As an example, they may be formed of adjacently-situated members rather than telescopically interfit members, with such members being maintained in adjacent translatable relationship by use of clips, collars, or other guides.

Third, the locking means may take a number of forms different from those noted above. As one example, the elastic band 128 might be omitted from the locking member 124, and the locking member 124 could be permanently affixed to its first strut member 104A/106A by a leaf spring or other biasing structure which biases the locking member 124 toward the second strut member 104B/106B. As another example, the second strut members 104B and 106B might include locking members 124 elastically biased radially outwardly (by a spring or the like), such that they remain depressed until they encounter the locking aperture 126 in the first strut member 104A/106A. The locking member 124 may then pop outwardly through the locking aperture 126 to fix the strut members 104A/104B and 106A/106B together until the locking member 124 is pushed inwardly with a user's fingers, or until sufficient force is applied between the first and second strut members 104A/104B and 106A/106B. However, the locking means described previously is preferred because its structure is simple, inexpensive, readily replaceable, and requires no hand actuation, and it allows a firm (but defeatable) connection between the strut members.

Fourth, the support leg 110 (or support legs 110, if more than one are provided) may be made movable by arrangements other than those described, such as by hinging it to its strut 104 and/or 106 so that it may swing about planes other than ones perpendicular to the struts 104 and 106 (for example, by swinging from a folded position parallel and adjacent to the first strut 104 to the support position shown in FIG. 1). However, the arrangement described above is preferred because it need not require any locking or fixing mechanism to hold the support leg 110 in its support position.

Fifth, it should be understood that the invention encompasses hurdles 100 which include some, but not all, of the features noted above (for example, a hurdle 100 having a crossbar 102 with adjustable height but lacking a movable support leg 110, or conversely a hurdle 100 having a movable support leg 110 but lacking an adjustable crossbar 102).

Sixth, collection handles 150 having structures different from the one described above may be used. As an example, the collection handle 150 may be formed entirely out of rigid material (i.e., the tubing 158 may be omitted), with the shaft 152 having a pivotable connection along its length so that its second end 156 may (after being inserted through the handle apertures 134 of the hurdles 100) be folded out of coaxial relationship with the length of the shaft 152, to abut and join to the first end 154 (which may have a hook defined thereon to close the loop of the collection handle 150 in a manner similar to a safety pin). As another alternative, the tubing 158 may be omitted and the second end 156 of the shaft 152 may bear an aperture for the insertion of a cotter pin or another blocking structure which prevents hurdles 100 from sliding off of the shaft 152 once installed thereon.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A hurdle comprising:
   a. an at least substantially horizontal upper crossbar having opposing bar ends;
   b. a first strut descending at least substantially vertically from the crossbar;
   c. a second strut descending at least substantially vertically from the crossbar, the second strut being spaced from the first strut;
   d. an at least substantially horizontal lower support leg extending from the first strut at or near the bottom of the first strut, wherein
      (1) the support leg terminates in a collar rotatably fit about the first strut,
      (2) the collar is closely situated between a pair of stops radially protruding from the first strut, and
      (3) the support leg is movable about the axis of the first strut to move into and out of coplanar alignment with the first strut and the crossbar;
   e. an elastomeric ring extending about the first strut between the collar and one of the stops, whereby the elastomeric ring bears against the collar and resists rotation of the collar about the first strut.

2. The hurdle of claim 1 wherein the support leg is rotatable about the axis of the first strut.

3. The hurdle of claim 1 wherein each strut includes:
   a. first and second strut members adjacently situated in slidable relationship, whereby each strut may be raised and lowered by sliding its strut members relative to each other, and
   b. locking means for locking the first and second strut members together at discretely spaced locations.

4. The hurdle of claim 3 wherein:
   a. the second strut member includes spaced indentations defined along its length, and
   b. the locking means includes a locking member elastically biased to extend from the first strut member into one of the indentations of the second strut member.

5. The hurdle of claim 4 wherein the locking member is elastically biased by an elastic band extending about the first strut member.

6. The hurdle of claim 5 wherein the elastic band is a helical spring extending about the first strut member.

7. The hurdle of claim 5 wherein the second strut member is telescopically situated within the first strut member.

8. A hurdle comprising:

a. an at least substantially horizontal upper crossbar having opposing bar ends;

b. a first strut descending at least substantially vertically from the crossbar;

c. a second strut descending at least substantially vertically from the crossbar, the second strut being spaced from the first strut;

d. an at least substantially horizontal lower support leg extending from the first strut at or near the bottom of the first strut, wherein the support leg is movable about the axis of the first strut to move into and out of coplanar alignment with the first strut and the crossbar, wherein each strut includes:

(1) first and second strut members adjacently situated in slidable relationship, whereby each strut may be raised and lowered by sliding its strut members relative to each other, and wherein:

i. the first strut member has a locking aperture, and ii. the second strut member includes spaced indentations defined along its length;

(2) a locking member with a curved surface elastically biased to extend through the locking aperture in the first strut member and at least partially through one of the indentations of the second strut member, wherein the locking member is elastically biased by an elastic band at least partially encircling the first strut member, whereby the locking member defeatably maintains the first and second strut members together.

9. The hurdle of claim 8 wherein the elastic band is a helical spring.

10. The hurdle of claim 8 wherein the elastic band also extends about the second strut member.

11. A hurdle comprising:

a. an at least substantially horizontal upper crossbar having opposing bar ends, wherein the crossbar includes a handle aperture extending through the crossbar between the bar ends;

b. a first strut descending at least substantially vertically from the crossbar;

c. a second strut descending at least substantially vertically from the crossbar, the second strut being spaced from the first strut;

d. an at least substantially horizontal lower support leg extending from the first strut at or near the bottom of the first strut, wherein the support leg is movable about the axis of the first strut to move into and out of coplanar alignment with the first strut and the crossbar; and e. a collection handle having a shaft sized to extend through the handle aperture, wherein the shaft of the collection handle further includes:

(1) a first end sized such that it cannot extend through the handle aperture, and (2) a second end:

i. ordinarily sized to extend through the handle aperture, and ii. reconfigurable to a size that cannot extend through the handle aperture.

12. A hurdle comprising:

a. an at least substantially horizontal upper crossbar having opposing bar ends;

b. spaced first and second struts descending at least substantially vertically from the crossbar, each strut including:

(1) first and second strut members adjacently situated in translatable relationship, whereby each strut may be raised and lowered by translating its strut members relative to each other, and (2) a locking member elastically biased to extend from the first strut member and at least partially through the second strut member, wherein the locking member is elastically biased by an elastic band extending about the first strut member and through the locking member, whereby the locking member defeatably maintains the first and second strut members together; and c. a lower support leg extending from the first strut at or near the bottom of the first strut, wherein the second strut member includes indentations defined therein into which the locking member extends, the indentations being spaced along its length.

13. The hurdle of claim 12 wherein the first strut member includes a locking aperture defined therein through which the locking member extends.

14. The hurdle of claim 12 wherein the elastic band is a helical spring.

15. The hurdle of claim 12 wherein the elastic band also extends about the second strut member.

16. The hurdle of claim 12 wherein the second strut member is telescopically situated within the first strut.

17. The hurdle of claim 12 wherein the support leg is movable about the axis of the first strut to move into and out of coplanar alignment with the first strut and the crossbar.

18. The hurdle of claim 12 wherein the support leg is movable with respect to the upper crossbar between:

a. a folded state wherein the outer leg end is situated at least substantially within a plane common to the first and second struts, and b. a supporting state wherein the outer leg end is situated out of a plane common to the first and second struts.

19. The hurdle of claim 12 wherein the support leg is rotatable about the axis of the first strut.

20. A hurdle comprising:

a. an at least substantially horizontal upper crossbar having opposing bar ends;

b. spaced first and second struts descending at least substantially vertically from the crossbar, each strut including:

(1) first and second strut members adjacently situated in translatable relationship, whereby each strut may be raised and lowered by translating its strut members relative to each other, and (2) a locking member elastically biased to extend from the first strut member and at least partially through the second strut member, whereby the locking member defeatably maintains the first and second strut members together;

c. a lower support leg extending from the first strut at or near the bottom of the first strut, wherein (1) the support leg terminates in a collar rotatably fit about the first strut, and (2) the collar is closely situated between a pair of stops radially protruding from the first strut;

d. an elastomeric ring extending about the first strut between the collar and one of the stops, whereby the elastomeric ring bears against the collar and resists rotation of the collar about the first strut.

21. A hurdle comprising:

a. an at least substantially horizontal upper crossbar having opposing bar ends, wherein the crossbar includes a handle aperture extending through the crossbar between the bar ends;

b. spaced first and second struts descending at least substantially vertically from the crossbar, each strut including:
(1) first and second strut members adjacently situated in translatable relationship, whereby each strut may be raised and lowered by translating its strut members relative to each other, and
(2) a locking member elastically biased to extend from the first strut member and at least partially through the second strut member, whereby the locking member defeatably maintains the first and second strut members together;
c. a lower support leg extending from the first strut at or near the bottom of the first strut; and
d. a collection handle having a shaft sized to extend through the handle aperture, wherein the shaft of the collection handle further includes:
(1) a first end sized such that it cannot extend through the handle aperture, and
(2) a second end:
i. ordinarily sized to extend through the handle aperture, and
ii. reconfigurable to a size that cannot extend through the handle aperture.

22. A hurdle comprising:
a. an at least substantially horizontal upper crossbar having opposing bar ends;
b. spaced first and second struts descending at least substantially vertically from the crossbar, each strut including:
(1) first and second strut members adjacently situated in slidable relationship, whereby each strut may be raised and lowered by sliding its strut members relative to each other, and
(2) locking means for locking the first and second strut members together at discretely spaced locations,
c. an at least substantially horizontal lower support leg extending from the first strut at or near the bottom of the first strut, wherein the lower support leg:
(1) is movable about the axis of the first strut to move into and out of coplanar alignment with the first strut and the crossbar, and
(2) terminates in a collar rotatably fit about the first strut, wherein the collar is closely situated between a pair of stops radially protruding from the first strut,
d. an elastomeric ring extending about the first strut between the collar and one of the stops, whereby the elastomeric ring bears against the collar and resists rotation of the collar about the first strut.

23. The hurdle of claim 22 wherein the support leg is rotatable about the axis of the first strut.

24. The hurdle of claim 22 wherein:
a. the second strut member includes indentations spaced along its length, and
b. the locking means includes a locking member extending from the first strut member into one of the indentations on the first strut member.

25. The hurdle of claim 24 wherein:
a. the locking member is elastically biased to extend from the first strut member into one of the indentations on the second strut member, and
b. the locking member has a curved surface extending into this indentation.

26. The hurdle of claim 24 wherein the first strut member includes a locking aperture through which the locking member extends.

27. The hurdle of claim 26 wherein the locking member is elastically biased to extend through the locking aperture and into one of the indentations on the second strut member.

28. The hurdle of claim 27 wherein the locking member is elastically biased by an elastic band extending about the first strut member.

29. The hurdle of claim 28 wherein the elastic band also extends about the second strut member.

30. The hurdle of claim 28 wherein the elastic band is a helical spring.

31. A hurdle comprising:
a. an at least substantially horizontal upper crossbar having opposing bar ends, wherein the crossbar includes a handle aperture extending through the crossbar between the bar ends,
b. spaced first and second struts descending at least substantially vertically from the crossbar, each strut including:
(1) first and second strut members adjacently situated in slidable relationship, whereby each strut may be raised and lowered by sliding its strut members relative to each other, and
(2) locking means for locking the first and second strut members together at discretely spaced locations,
c. an at least substantially horizontal lower support leg extending from the first strut at or near the bottom of the first strut, wherein the lower support leg is movable about the axis of the first strut to move into and out of coplanar alignment with the first strut and the crossbar; and
d. a collection handle having a shaft sized to extend through the handle aperture.

32. The hurdle of claim 31 wherein the shaft of the collection handle further includes:
a. a first end sized such that it cannot extend through the handle aperture, and
b. a second end:
(1) ordinarily sized to extend through the handle aperture, and
(2) reconfigurable to a size that cannot extend through the handle aperture.

33. A hurdle comprising:
a. an at least substantially horizontal upper crossbar having opposing bar ends, wherein the crossbar includes a handle aperture extending through the crossbar between the bar ends;
b. spaced first and second struts descending from the crossbar, wherein each strut includes:
(1) first and second strut members adjacently situated in slidable relationship, whereby each strut may be raised and lowered by sliding its strut members relative to each other, and
(2) a locking member which defeatably engages the first and second strut members together at discretely spaced locations along the length of the second strut; and
and wherein:
i. the second strut member includes indentations defined therein, the indentations being discretely spaced along the length of the second strut member, and
ii. the locking member is elastically biased to extend from the first strut member into one of the indentations of the second strut member;
c. a lower support leg extending from the first strut at or near the bottom of the first strut and terminating at an outer leg end, wherein the lower support leg is movable with respect to the upper crossbar between:

(1) a folded state wherein the outer leg end is situated at least substantially within a plane common to the first and second struts, and (2) a supporting state wherein the outer leg end is situated out of a plane common to the first and second struts, and wherein an elastomeric member situated on the first strut bears against the support leg and resists motion of the support leg between the folded and supporting states;

d. a collection handle having a shaft sized to extend through the handle aperture.

34. The hurdle of claim 33 wherein the shaft of the collection handle further includes:

a. a first end sized such that it cannot fit through the handle aperture, and b. a second end movable into and out of coaxial relationship with the shaft.

35. The hurdle of claim 33 wherein the lower support leg is rotatable about the axis of the first strut.

36. The hurdle of claim 33 wherein the elastomeric member is an elastomeric ring extending about the first strut.

* * * * *